United States Patent [19]

Walker et al.

[11] Patent Number: 4,838,550

[45] Date of Patent: Jun. 13, 1989

[54] PNEUMATIC BALL AMUSEMENT GAME

[76] Inventors: Howard Walker; Charles Walker, both of 37 Amby Ave., Plainview, N.Y. 11803

[21] Appl. No.: 192,775

[22] Filed: May 10, 1988

[51] Int. Cl.[4] ..... A63F 7/00; A63F 9/14

[52] U.S. Cl. ..... 273/86 R; 273/123 A

[58] Field of Search ..... 273/86 R, 123 A

[56] References Cited

U.S. PATENT DOCUMENTS 2,197,520 4/1940 Ebert ..... 273/123 A
2,317,506 4/1943 Williams et al. ..... 273/123 A
2,614,840 10/1952 Monkres ..... 273/86 R X
2,627,411 2/1953 Bartlam et al. ..... 273/86 R

FOREIGN PATENT DOCUMENTS 2077 of 1926 Australia ..... 273/123 A

*Primary Examiner*—Anton O. Oechsle
*Attorney, Agent, or Firm*—Michael I. Kroll

[57] ABSTRACT

A pneumatic call amusement game is provided and consists of players rolling balls across playing tables in which the balls are pneumatically propelled into hoppers spaced back from and elevated above the table until one of the players places a predetermined amount of balls into the respective hopper needed to win.

7 Claims, 2 Drawing Sheets

PNEUMATIC BALL AMUSEMENT GAME

BACKGROUND OF THE INVENTION

1. Field of the Invention

The instant invention relates generally to games and more specifically it relates to a pneumatic ball amusement game.

2. Description of the Prior Art

Numerous games have been provided in prior art that are adapted to utilize balls which require people who play the games the combination of skill and chance to master playing the games. While these units may be suitable for the particular purpose to which they address, they would not be as suitable for the purposes of the present invention as heretofore described.

SUMMARY OF THE INVENTION

A primary object of the present invention is to provide a pneumatic ball amusement game that will overcome the shortcomings of the prior art devices.

Another object is to provide a pneumatic ball amusement game that will give pleasure to each player during the play of the game when compressed air propels balls into hoppers to find out which player is the winner.

An additional object is to provide a pneumatic ball amusement game that will give a prize to one player who wins the game so as to motivate each player to play the game to win.

A further object is to provide a pneumatic ball amusement game that is simple and easy to use.

A still further object is to provide a pneumatic ball amusement game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
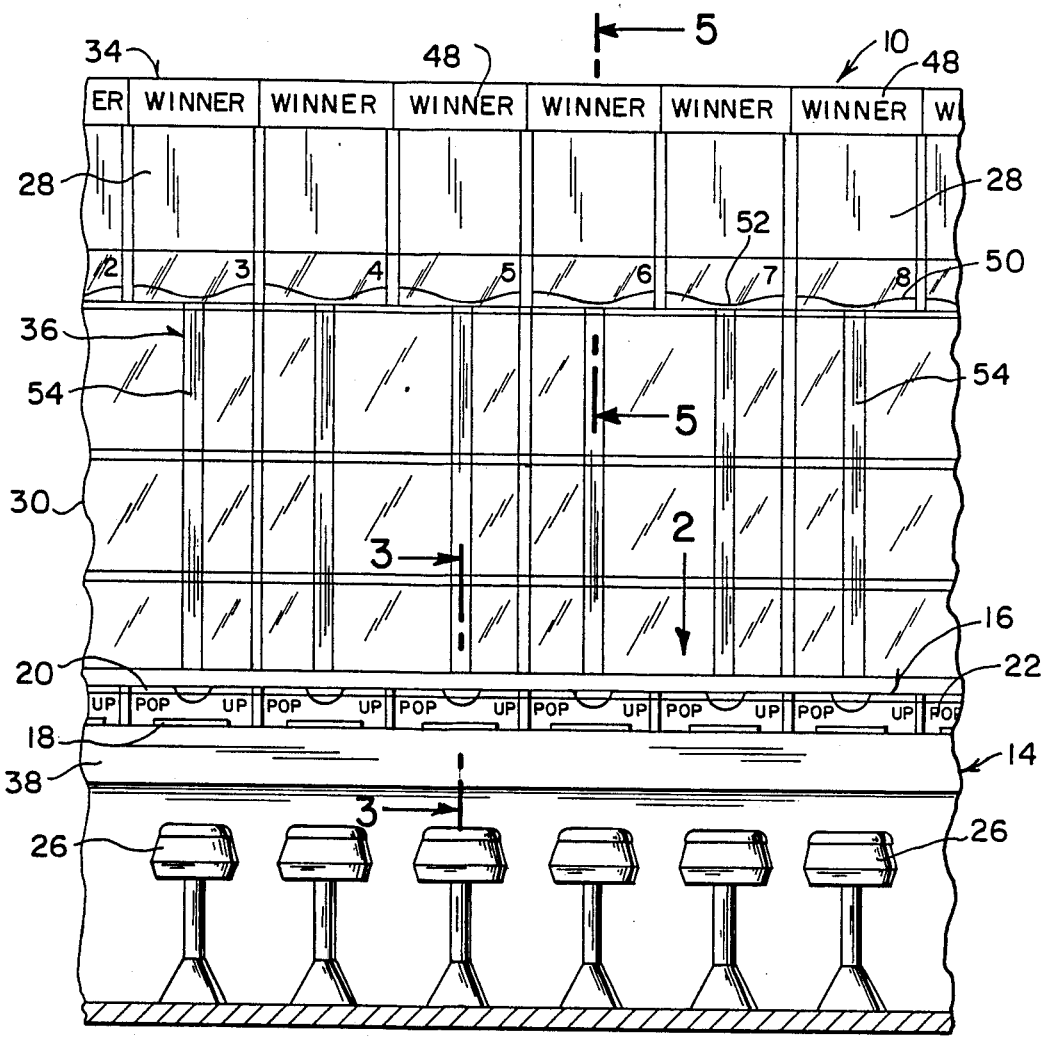
FIG. 1 is a front view of the invention with parts broken away.
Figure 2:
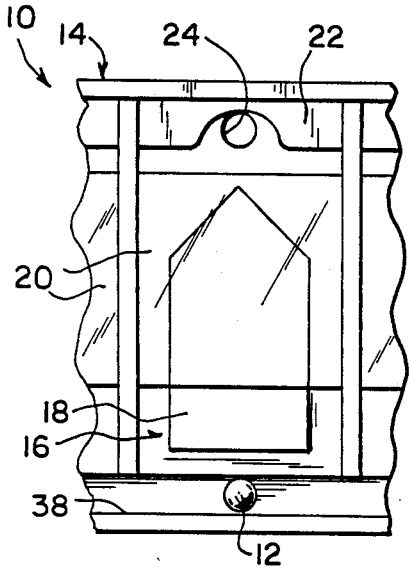
FIG. 2 is a top view as indicated by numeral 2 in FIG. 1 showing one of the playing areas.
Figure 3:
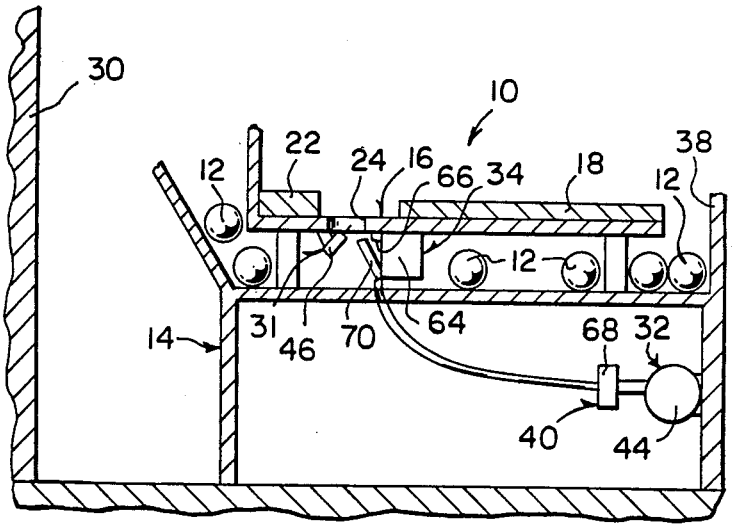
FIG. 3 is a cross sectional view taken along line 3—3 in FIG. 1.
Figure 4:
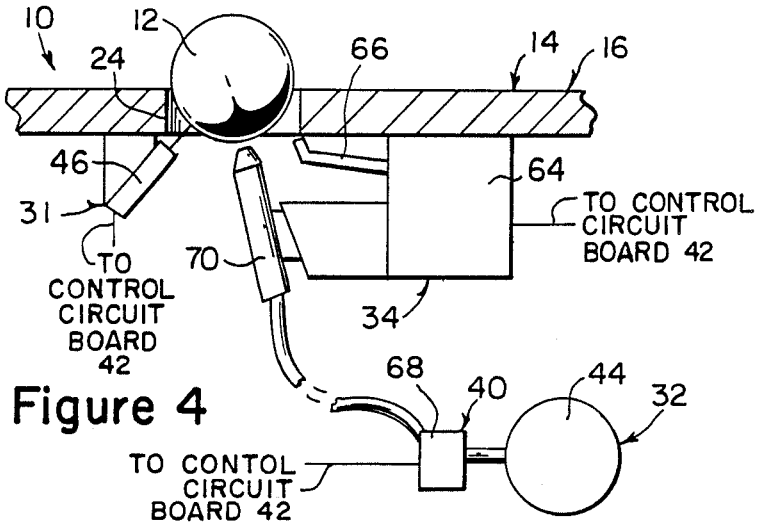
FIG. 4 is an enlarged detail view of the pneumatic mechanism shown in FIG. 3.
Figure 5:
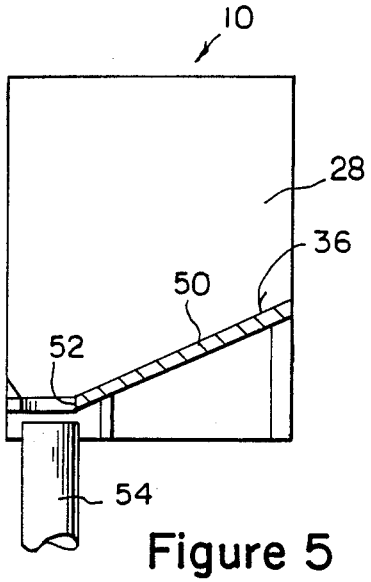
FIG. 5 is a cross sectional view taken along line 5—5 in FIG. 1 through one of the hoppers.
Figure 6:
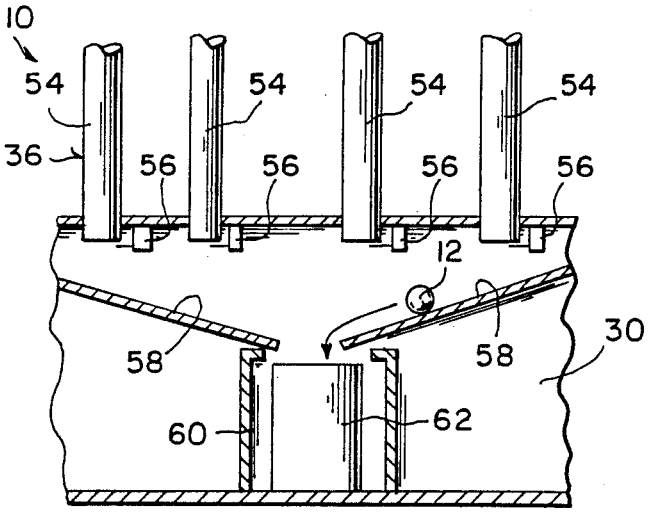
FIG. 6 is a cross sectional view taken through the hopper housing the ball return container therein.
Figure 7:
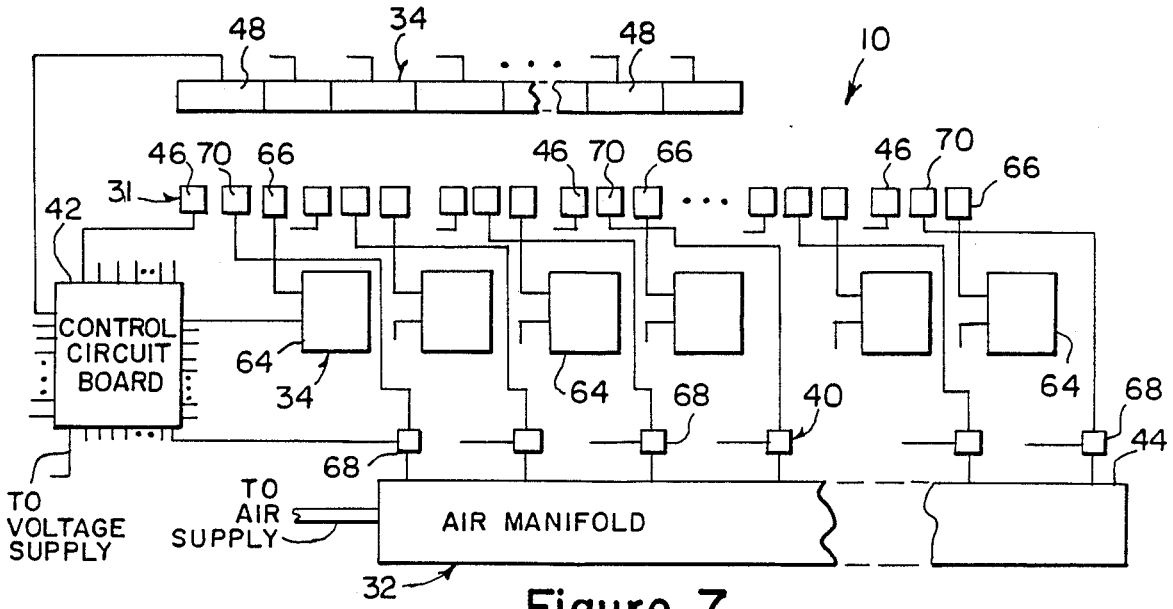
FIG. 7 is a block diagram of the electrical and pneumatic circuit of the invention.

Turning now descriptively to the drawings, in which similar reference characters denote similar elements throughout the several views, FIGS. 1 through 7 illustrate a pneumatic ball amusement game 10 consisting of a plurality of balls 12 and an elongated playing table 14 that has a plurality of separated playing tops 16. Each of the tops 16 has a platform 18, a transparent elevated plate 20, a rear bumper 22 and a rear aperture 24 to hold one of the balls 12 rolled thereupon by a player (not shown). A plurality of seats 26 are provided in which each is positioned in front of one of the playing tops 16 for the player to sit upon. A plurality of hoppers 28 are spaced back from and elevated above the playing table 14 onto a hopper housing 30. A first mechanism 31 is provided for expelling any of the balls 12 from the rear aperture 24 on any of the playing tops 16 before start of the game 10. A second mechanism 32 is for pneumatically propelling the balls 12 from the rear aperture 24 on each of the playing tops 16 into each of the hoppers 28. A third mechanism 34 is for indicating winner of the game 10 when a predetermined right amount of balls 12 are received into one of the hoppers 28. A control circuit board 42 is electrically connected to the expelling mechanism 31, the pneumatically propelling mechanism 32 and the winner indicating mechanism 34.

A structure 36 is for gathering the balls 12 from the hoppers 28 so that the balls 12 can be returned back to the playing table 14 into a tray 38 and be used again in playing of the game 10.

The expelling mechanism 31 includes a plurality of push type solenoids 46, each of which is located below each of the playing tops 16 adjacent the rear aperture 24. Each of the push type solenoids 46 is electrically connected to the control circuit board 42 so that when any of the balls 12 sits upon the rear aperture 24 the ball 12 will be ejected back onto the playing top 16 before start of the game 10.

The pneumatically propelling mechanism 32 includes a plurality of ball thrust units 40, each of which is located below each of the playing tops 16 adjacent the rear aperture 24 and is electrically connected to the control circuit board 42. An air manifold 44 supplies compressed air to each of the ball thrust units 40. When each of the balls 12 is rolled upon the playing tops 16 and sits upon the rear apertures 24 thereof, each of the respective ball thrust units 40 will be activated to propell the ball 12 by the compressed air into the respective hopper 28.

The winner indicating mechanism 34 includes a plurality of pick up sensors 64, each having a sensor arm 66 located below each of the playing tops 16 adjacent the rear aperture 24 and electrically connected to the control circuit board 42. When each of the balls 12 sits upon the rear aperture 24 the ball 12 will be counted before it is propelled into the respective hopper 28. A plurality of winner sign lights 48 are provided in which each is located above one of the hoppers 28 and electrically connected to the control circuit board 42 so that when the predetermined right amount of balls 12 are counted by one of the pick up sensors 64, the respective winner sign light 48 will be illuminated from the control circuit board 42.

The ball gathering structure 36 includes each of the hoppers 28 having a tapered floor 50 with an aperture 52 therein for receiving the balls 12. A tube 54 extends downwardly from each aperture 52 in each of the hoppers 28 and a catcher solenoid 56 is positioned right below each end of each tube 54 to hold the balls 12 therein until end of the game 10. A ramp 58 is positioned below the catcher solenoids 56 so that when the balls 12 are released by the catcher solenoids 56 the ramp 58 will direct the balls 12 to a central location with a compartment 60 located at the central location. A container 62 is placed into the compartment 60 to receive the balls 12 therein, so that the container 62 can be removed and emptied into the tray 38.

Each of the ball thrust units 40 includes an air solenoid 68 is electrically connected to the pick up sensor 64 and pneumatically connected to the air manifold 44. An air nozzle 70 is pneumatically connected to the air solenoid 68 and positioned below the rear aperture 24 in the playing top 16 so that when one of the balls 12 is rolled upon the rear aperture 24 the pick up sensor 64 will be activated to operate the air solenoid 68 causing a blast of air to exit from the air nozzle 70 to propel the ball 12 into the respective hopper 28.

There are alternate ways of propelling the balls 12 from the playing table 14 instead of using the pneumatically propelling mechanism 32 shown in the drawings. For example: (a) a pivot arm connected to an electric solenoid or pneumatic piston; (b) striking the ball 12 directly with an electric solenoid or pneumatic piston; and (c) striking the ball 12 with a spring. There can also be multiple rear apertures 24 on each of the playing tops 16 which have different score values to determine the winner of the game 10.

LIST OF REFERENCE NUMBERS

10 pneumatic ball amusement game
12 ball
14 playing table
16 playing top
18 platform
20 transparent elevated plate
22 rear bumper
24 rear aperture
26 seat
28 hopper
30 hopper housing
32 pneumatically propelling mechanism
34 winner indicating mechanism
36 ball gathering structure
38 tray
40 ball thrust unit
42 control circuit board
44 air manifold
46 push type solenoid
48 winner sign light
50 tapered floor
52 aperture
54 clear plastic tube
56 catcher solenoid
58 ramp
60 compartment
62 container
64 pick up sensor
66 sensor arm
68 air solenoid
70 air nozzle It will be understood that each of the elements described above, or two or more together, may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letter Patent is set forth in the appended claims.

1. A pneumatic ball amusement game which comprises:

(a) a plurality of balls;
(b) an elongated playing table having a plurality of separated playing tops, each of said tops having a rear aperture to hold one of said balls rolled thereupon by a player;
(c) a plurality of seats, each of which is positioned in front of one of said playing tops for the player to sit upon;
(d) a plurality of hoppers, spaced back from and elevated above said playing table;
(e) means for expelling any of said balls from said rear aperture on any of said playing tops before start of said game;
(f) means for pneumatically propelling said balls from said rear aperture on each of said playing tops into each of said hoppers;
(g) means for indicating winner of said game when a predetermined right amount of said balls are received into one of said hoppers; and
(h) a control circuit board electrically connected to said expelling means, said pneumatically propelling means and said winner indicating means.

2. A pneumatic ball amusement game as recited in claim 1, further comprising means for gathering said balls from said hoppers so that said balls can be returned back to said playing table and be used again in playing of said game.

3. A pneumatic ball amusement game as recited in claim 2, wherein said expelling means includes a plurality of push type solenoids, each of which is located below each of said playing tops adjacent said rear aperture and electrically connected to said control circuit board so that when any of said balls sits upon said rear aperture said ball will be ejected back onto said playing top before start of said game.

4. A pneumatic ball amusement game as recited in claim 3, wherein said pneumatically propelling means includes:

(a) a plurality of ball thrust units, each of which is located below each of said playing tops adjacent said rear aperture and is electrically connected to said control circuit board; and
(b) an air manifold to supply compressed air to each of said ball thrust units, so that when each of said balls is rolled upon said playing tops and sits upon said rear apertures thereof, each of said respective ball thrust units will be activated to propel said ball by the compressed air into said respective hopper.

5. A pneumatic ball amusement game as recited in claim 4, wherein said winner indicating means includes:

(a) a plurality of pick up sensors, each having a sensor arm located below each of said playing tops adjacent said rear aperture and electrically connected to said control circuit board, so that when each of said balls sits upon said rear aperture said ball will be counted before its propelled into said respective hopper; and (b) a plurality of winner sign lights, each of which is located above one of said hoppers and electrically connected to said control circuit board so that when the predetermined right amount of said balls are counted by one of said pick up sensors, said respective winner sign lights will be illuminated from said control circuit board.

6. A pneumatic ball amusement game as recited in claim 5, wherein said gathering means includes:

(a) each of said hoppers having a tapered floor with an aperture therein for receiving said balls;

(b) a plurality of tubes, each of which extends downwardly from one said aperture in said hopper;

(c) a plurality of catcher solenoids, each of which is positioned right below each end of each of said tubes to hold said balls therein until end of said game;

(d) a ramp positioned below said catcher solenoids so that when said balls are released by said catcher solenoids said ramp will direct said balls to a central location;

(e) a compartment located at the central location; and (f) a container placed into said compartment to receive said balls therein, so that said container can be removed and emptied.

7. A pneumatic ball amusement game as recited in claim 6, wherein each of said ball thrust units includes:

(a) an air solenoid electrically connected to said pick up sensor and pneumatically connected to said air manifold; and (b) an air nozzle pneumatically connected to said air solenoid and positioned below said rear aperture in said playing top so that when one of said balls is rolled upon said rear aperture said pick up sensor will be activated to operate said air solenoid causing a blast of air to exit from said air nozzle to propel said ball into said respective hopper.

* * * * *